US006550520B1

(12) United States Patent
Rossini et al.

(10) Patent No.: US 6,550,520 B1
(45) Date of Patent: Apr. 22, 2003

(54) INSULATING GLAZING UNIT PROVIDED WITH A BLIND

(75) Inventors: Mauro Rossini, Este (IT); Vanni Gallocchio, Montegrotto Terme (IT)

(73) Assignee: Finvetro S.r.l., Este (IT)

( * ) Notice: Subject to any disclaimer, the term of this patent is extended or adjusted under 35 U.S.C. 154(b) by 0 days.

(21) Appl. No.: 09/526,530

(22) Filed: Mar. 16, 2000

(30) Foreign Application Priority Data

Mar. 17, 1999 (IT) ..... PD99A0052

(51) Int. Cl.[7] ..... E06B 9/264
(52) U.S. Cl. ..... 160/107; 160/89; 160/167 R
(58) Field of Search ..... 160/84.02, 107, 160/115, 84.03, 89, 167 R, 84.04

(56) References Cited

U.S. PATENT DOCUMENTS 5,083,598 A * 1/1992 Schon ..... 160/84.02
5,699,845 A * 12/1997 Jelic ..... 160/107
6,059,006 A * 5/2000 Rossini ..... 160/107
6,065,524 A * 5/2000 Rossini ..... 160/107
6,123,137 A * 9/2000 Levert ..... 160/107

* cited by examiner

*Primary Examiner*—David M. Purol
(74) *Attorney, Agent, or Firm*—Guido Modiano; Albert Josif; Daniel O'Byrne

(57) ABSTRACT

An insulating glazing unit internally provided with a blind which is adapted to be moved from a fully gathered condition to an unfolded condition, and vice versa. The blind, in the gathered configuration, is arranged in the lower part and interacts with an arrangement for pulling a flap in order to unfold it from the bottom upward until the insulating glazing unit is fully blacked out.

17 Claims, 5 Drawing Sheets

INSULATING GLAZING UNIT PROVIDED WITH A BLIND

BACKGROUND OF THE INVENTION

The present invention relates to an insulating glazing unit internally provided with a blind.

Insulating glazing units are currently widely used, most of all because of their appreciable heat- and sound-insulation characteristics.

It is known that insulating glazing units are of the type that comprises a perimetric frame which supports two parallel panes of glass so as to form a sealed air space between them.

In many applications, between the two glass panes, inside the air space, there is a Venetian blind constituted by a set of mutually parallel slats which are held together by cords for adjusting inclination and gathering.

In recent years, insulating glazing units with a Venetian blind whose gathering and unfolding are actuated by automatic actuation means have become widely used.

Venetian blinds, however, are unable to ensure complete blackout and accordingly, when the user deems this necessary, they are combined with a blind applied outside the insulating glazing unit.

As an alternative, insulating glazing units are commercially available which are provided with an internal blind which is rolled up and unrolled around a roller which can be actuated by roll-up/unrolling mechanisms.

In practice, however, these mechanisms are rather complicated, since they must be contained in the insulated region of the air space, bearing in mind the fact that the volume of the rolled-up blind considerably limits the available space.

Accordingly, insulating glazing units of this type have not been very successful indeed because of the complexity of the mechanism for rolling up/unrolling the blind.

Other insulating glazing units are commercially available which are provided with a pleated blind made of a material, or having a structure, which blocks the light; the blind is made to descend from the top by means of adjustment cords in a manner which is fully equivalent to what occurs during the unfolding of Venetian blinds.

Unfortunately, in blinds of this type it is necessary to provide holes through which said cords must be passed; said holes accordingly make it impossible to achieve complete blackout.

It is interesting to note that in any case the user must choose whether to install an insulating glazing unit with a shading Venetian blind or an insulating glazing unit with a blackout blind, even though blackout is incomplete (due to the holes present on said blind) or is easily subject to malfunctions (due to the complexity of the mechanisms for actuating blinds rolled around a roller).

The only possible alternative for providing the user with the maximum freedom of choice is to couple two insulating glazing units, one in front of the other, which are respectively internally provided with a shading Venetian blind and with a blackout blind.

Clearly, however, this last solution, which is the only truly complete one for the user, is also very onerous and so far has accordingly seen limited application.

SUMMARY OF THE INVENTION

The aim of the present invention is to provide an insulating glazing unit provided with a blind which solves the drawbacks noted above of conventional units.

Within the scope of this aim, an important object of the present invention is to provide an insulating glazing unit with a blind which can simultaneously also include a shading Venetian blind.

Another important object of the present invention is to provide an insulating glazing unit provided with a blind which ensures complete blackout when it is unfolded.

Another object of the present invention is to provide an insulating glazing unit with a blind whose roll-up and unfolding mechanism is functional and extremely simple.

Another object of the present invention is to provide an insulating glazing unit with a blind with can be manufactured at costs which are fully comparable to the costs of normally commercially available insulating glazing units.

This aim, these objects and others which will become apparent hereinafter are achieved by an insulating glazing unit internally provided with a blind which can be moved from a fully gathered condition to an unfolded condition, and vice versa, characterized in that said blind, in the gathered configuration, is arranged in the lower part and interacts with means for pulling a flap in order to unfold it from the bottom upward until said insulating glazing unit is fully blacked out.

BRIEF DESCRIPTION OF THE DRAWINGS

Further characteristics and advantages of the present invention will become apparent from the description of two preferred embodiments thereof, illustrated only by way of non-limitative example in the accompanying drawings, wherein.

DESCRIPTION OF THE PREFERRED EMBODIMENTS

Figure 1:
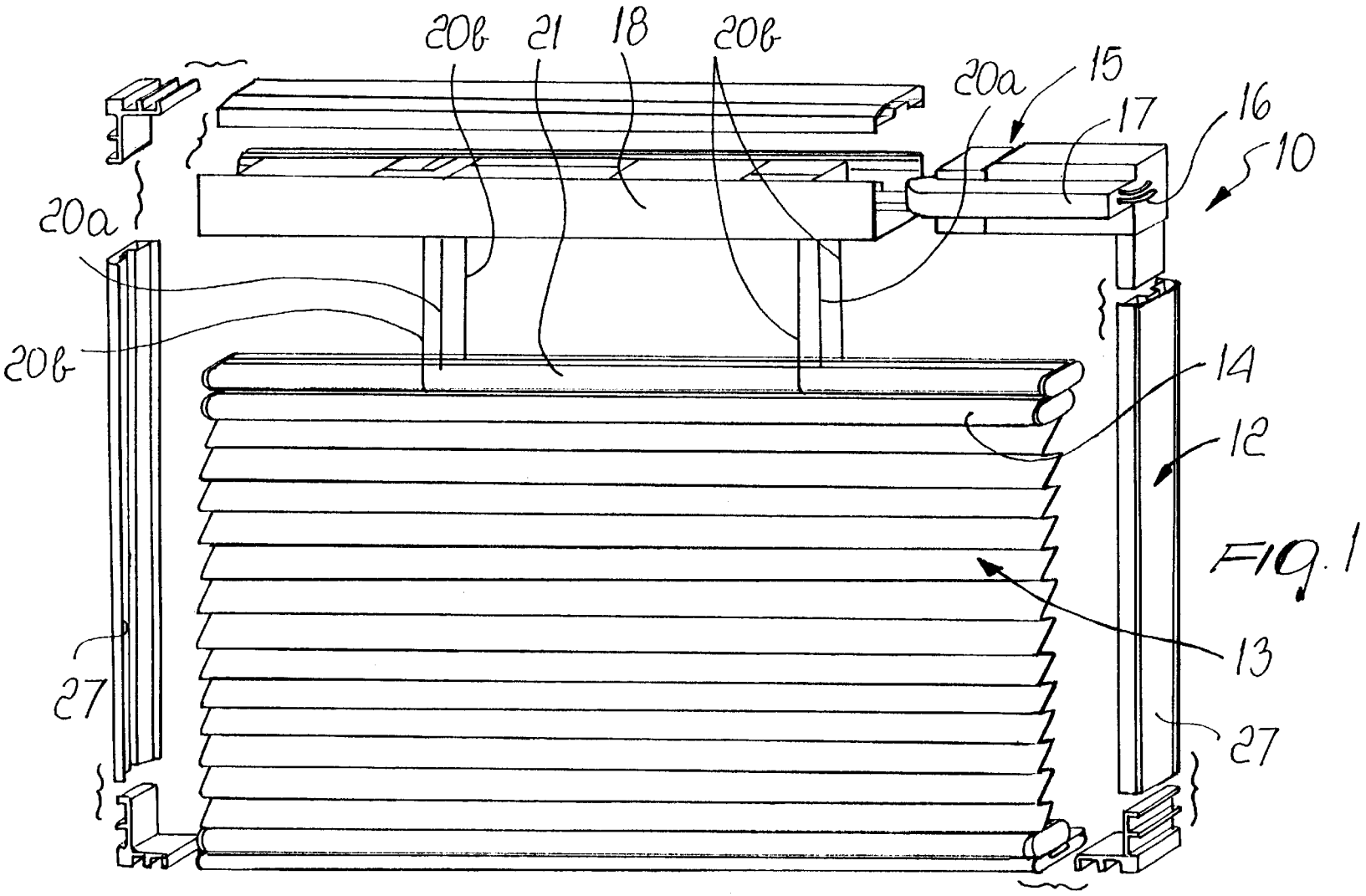
FIG. 1 is an exploded view of an insulating glazing unit internally provided with a blind during unfolding.
Figure 3:
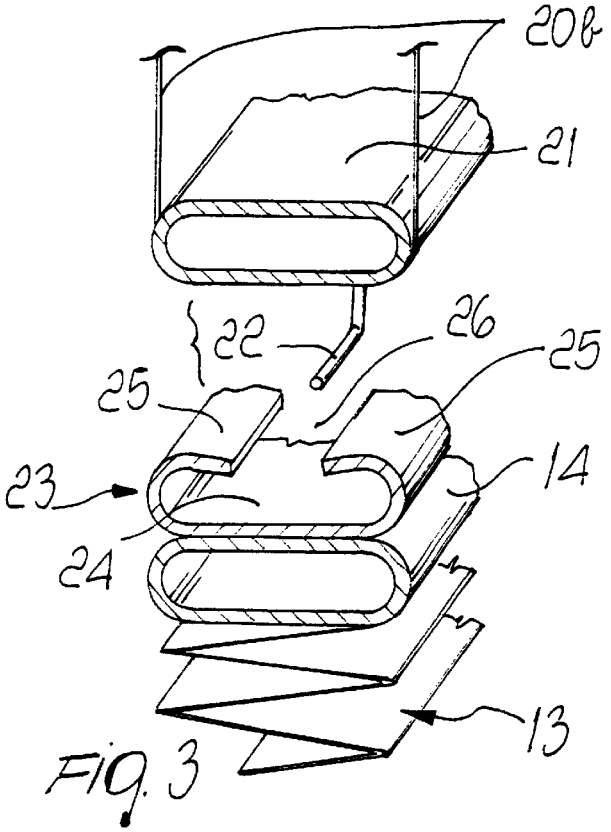
FIG. 3 is an exploded view of a detail of the blind of FIGS. 1 and 2.
Figure 2:
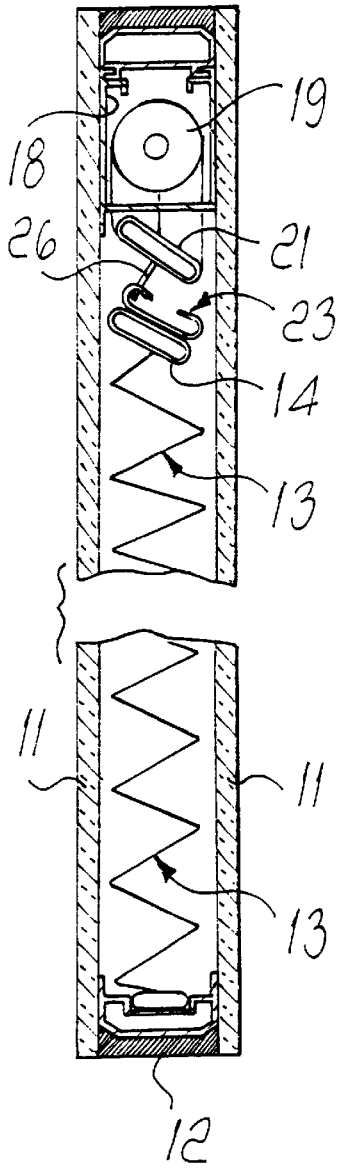
FIG. 2 is a sectional view, taken along a transverse plane, of the blind of FIG. 1 in the fully unfolded position.

With reference to the above-cited FIGS. 1 to 5, an insulating glazing unit provided with a blind according to the invention is generally designated by the reference numeral 10 and comprises two glazed surfaces 11 which are supported by a perimetric frame 12 which in this case is made of aluminum, so as to form an air space.

A layer of sealant, not shown in the above figures for the sake of simplicity, is spread along the entire edge of the frame 12 and is suitable to hermetically seal the insulating glazing unit 10 with respect to the outside.

The insulating glazing unit 10 is provided with a blind 13, which in this case is a pleated blind which is associated, by means of its upper flap, with a bar 14 which has substantially the same extension as the air space.

The insulating glazing unit 10 is provided with a traction-type actuation device, generally designated by the reference numeral 15, which comprises a motor 16 arranged inside a box-like body 17 which is applied to the outside of an insulating glazing unit 18 which is also box-shaped and is fixed to the upper part of the insulating glazing unit 10.

In particular, the motor 16 can be removed easily from the box-like body 17 for maintenance or for replacement in case of breakage.

The insulating glazing unit 10 has, in this embodiment, a magnetic kinematic coupling device, not shown in the above figures for the sake of simplicity, which is adapted to transmit the rotary motion of the motor 16, arranged inside the box-like body 17, to a shaft 19 which is arranged inside the frame 18.

Adjustment cords 20 wind and unwind around said shaft 19 and are all fixed, at one end, to a structural bar 21 whose dimensions are equivalent to those of the bar 14 that supports the pleated blind 13 and whose cross-section is substantially rectangular with rounded corners.

In particular, the cords 20 can be divided into orientation cords 20*a*, which are suitable to adjust, in a per se known manner, the angle of inclination of the structural bar 21, and movement cords 20*b*, which are responsible for the vertical translatory motion (traction) of said structural bar 21 inside the air space.

First engagement/disengagement means are provided on said structural bar 21 and are constituted, in this case, by two hooks 22, each of which is L-shaped and is fixed to one end of the structural bar 21 at the face that is directed toward the lower part of the insulating glazing unit 10.

Correspondingly, second engagement/disengagement means are fixed on the bar 14 that supports the pleated blind 13 and are constituted by two elements 23, each of which is C-shaped and is associated with the upper part of the bar 14 at one end thereof.

In particular, each one of said C-shaped elements 23 comprises a flat back 24 which is fixed on top of one end of the bar 14 and from which two arc-like wings 25 protrude from opposite positions; said wings are folded over the back 24 and between them there is an access region 26 through which the corresponding hook 22 can penetrate, as will become apparent hereinafter, and be retained by one of the two arc-like wings 25.

The structural bar 21 is in fact adapted to couple/uncouple with respect to the bar 14 that supports the pleated blind 13.

Said blind, when blackout is not being provided, is simply gathered at the bottom of the insulating glazing unit 10.

In summary, when the user wishes to blackout the insulating glazing unit 10 he actuates the motor 16, which transmits its motion to the shaft 19, so that first of all the orientation cords 20*a* tilt the structural bar 21, which is in fact horizontal in the inactive condition, and immediately thereafter the movement cords 20*b* cause said bar to descend until it reaches the lower part of the insulating glazing unit 10.

Once it has arrived proximate to the bar 14 that supports the pleated blind 13, each end of the structural bar 21, due to its inclination, touches only one of the two arc-like wings 25, thus allowing the hook 22 to penetrate through the access region 26 and enter, by way of the weight of the structural bar 21, which tends to change its inclination after touching only one of the wings 25, the region under the other wing 25, so as to engage therein.

Figure 4:
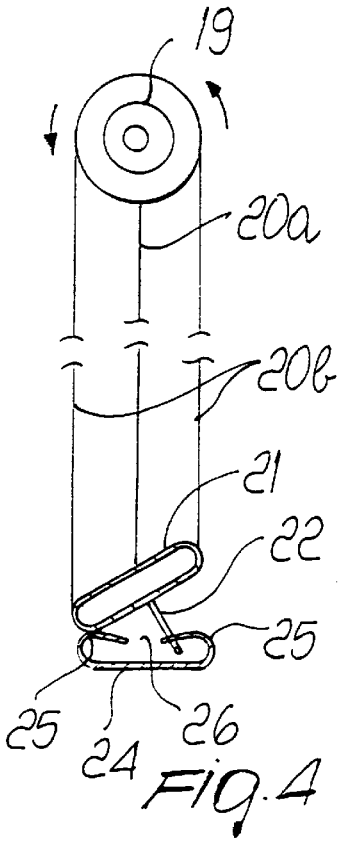
FIG. 4 is a schematic sectional view, taken along a transverse plane, of the blind of the preceding figures in an initial unfolding step.

Thereafter, the actuated shaft 19, by continuing to turn in the same direction, allows the movement cords 20*b*, which had substantially reached the end of their stroke, as shown in FIG. 4, to wind back onto said shaft, so as to raise the structural bar 21, which moves with it the bar 14 that supports the pleated blind 13.

In this manner, the pleated blind 13 blacks out the insulating glazing unit 10 by moving upward.

Complete blackout is of course achieved when the bar 14 has reached the upper part of the insulating glazing unit 10, i.e., when the cords 20 have been fully wound around the shaft 19.

When the user wishes to lower the pleated blind 13, in any raised position it may be, he merely has to actuate the motor 16 so that it starts to turn the shaft 19 in the opposite direction.

In this manner, the orientation cords 20*a* first of all change the inclination of the structural bar 21 and accordingly change the arrangement of the hook 22, which prepares itself for uncoupling.

Figure 5:
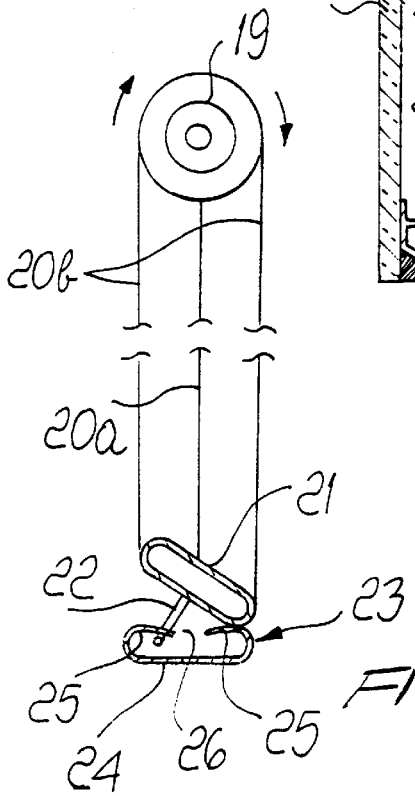
FIG. 5 is a schematic sectional view, taken along a transverse plane, of the blind of FIG. 4 in a gathering step.

Immediately thereafter, the movement cords 20*b* start to unwind around the shaft 19, thus allowing to lower the structural bar 21 (which would tend to descend due to its own weight) and accordingly the bar 14 that supports the blind 13 until it reaches the lower part of the insulating glazing unit 10, as shown in FIG. 5.

At this point, once the blind 13 has been fully gathered inside the air space on the bottom of the insulating glazing unit 10, said bar 14 rests at said bottom, so that the structural bar 21 touches, due to its inclination, only one of the arc-like wings 25.

Thereafter, the inclination of the structural bar 21 changes due to the weight of the bar, so that the hook 22 can easily reach the access region 26 and then exit from the C-shaped element 23 so as to uncouple the bar 14 that supports the blind 13 from the structural bar 21.

In particular, in a different embodiment, it is possible to form, at each one of the two posts 27 of the perimetric frame 12, a seat inside which the ends of said pleated blind 13 can slide vertically during the unfolding/gathering thereof.

With this technical solution, the blackout of the insulating glazing unit 10 is absolutely complete, since the light rays can no longer pass through the cracks that can form between the lateral ends of the pleated blind 13 and the corresponding edge of the insulating glazing unit 10.

In a further embodiment, the blind can be of the type to be wound and unwound around a roller which is arranged in the lower part of the insulating glazing unit.

In this particular embodiment, the roller is provided with an elastic return spring, so that the blind can be raised from below by coupling its supporting bar to the structural bar, whereas it is unwound from the roller by way of the actuation of the actuation device.

Gathering of the blind around the roller is instead automatic as soon as the actuation device allows it, by way of the presence of the elastic return spring.

The spring renders the kinematic system independent of the action of the weight of the blind during unfolding/gathering, so that it is possible to better provide for the tilting of the insulating glazing unit in tilt-open embodiments.

Figure 6:
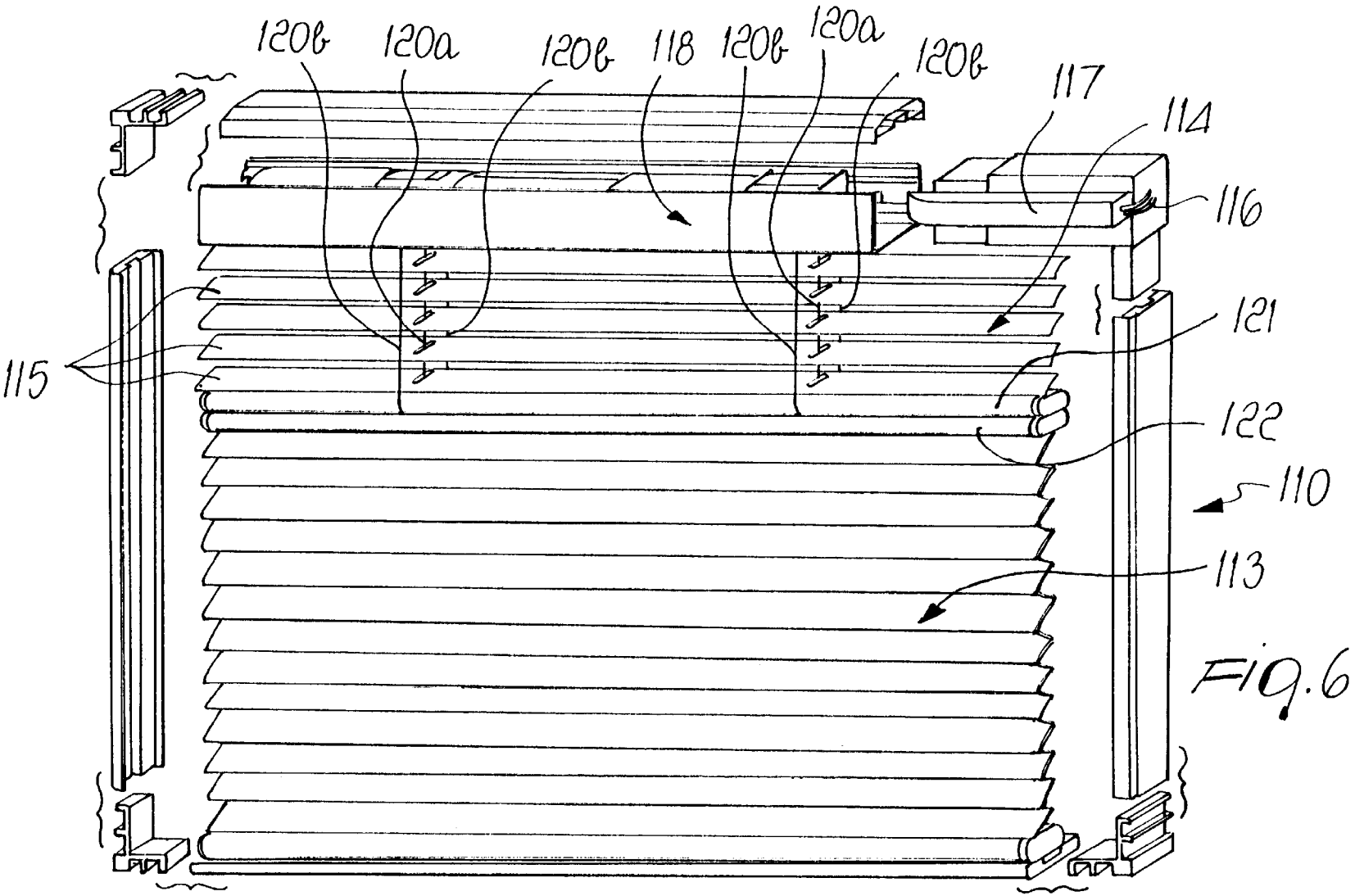
FIG. 6 is an exploded view of a different embodiment of an insulating glazing unit according to the present invention, internally provided with a blackout blind and with a shading blind.
Figure 7:
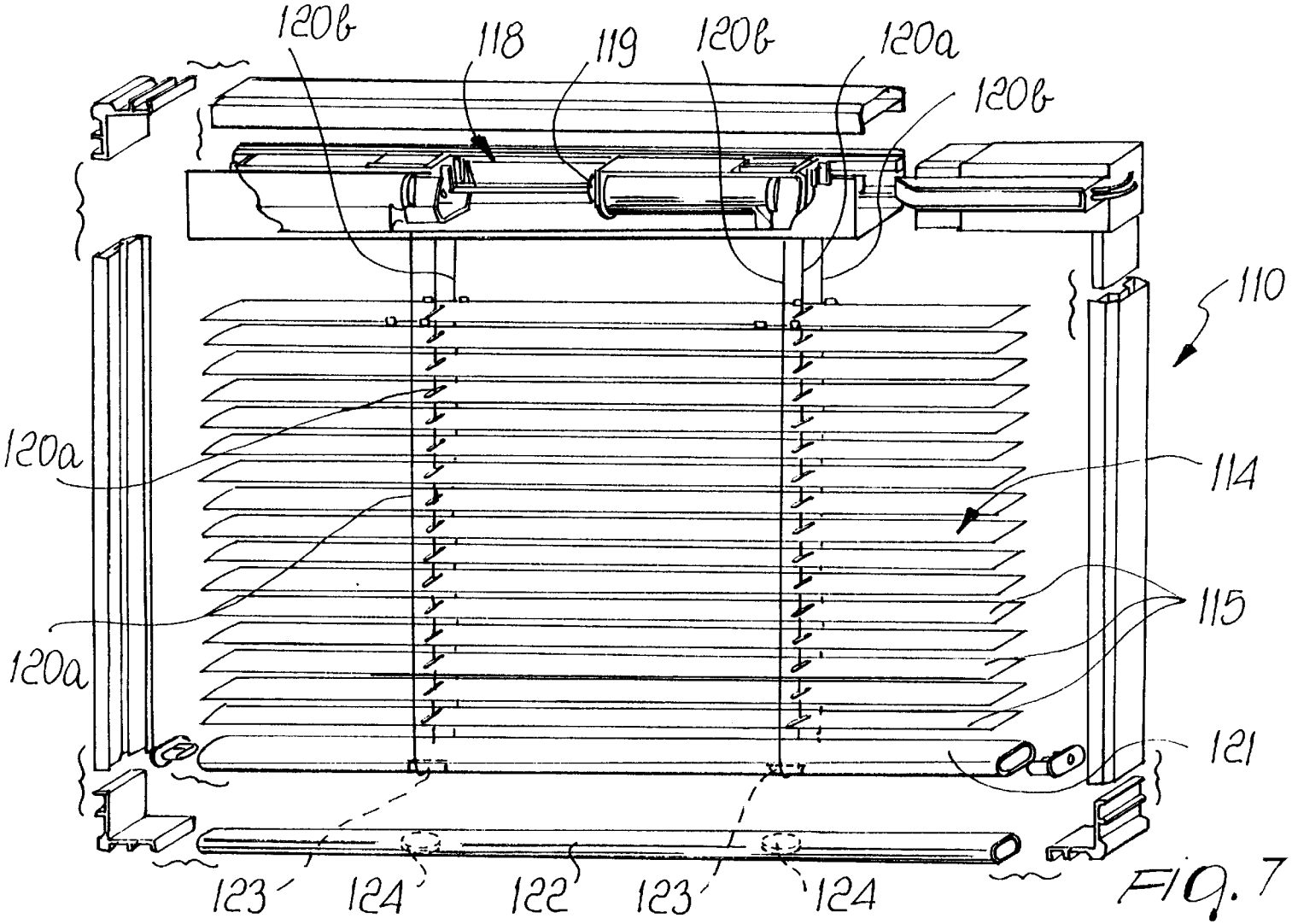
FIG. 7 is an exploded view of the blind of FIG. 6 during the pre-unfolding of the blackout blind.
Figure 8:
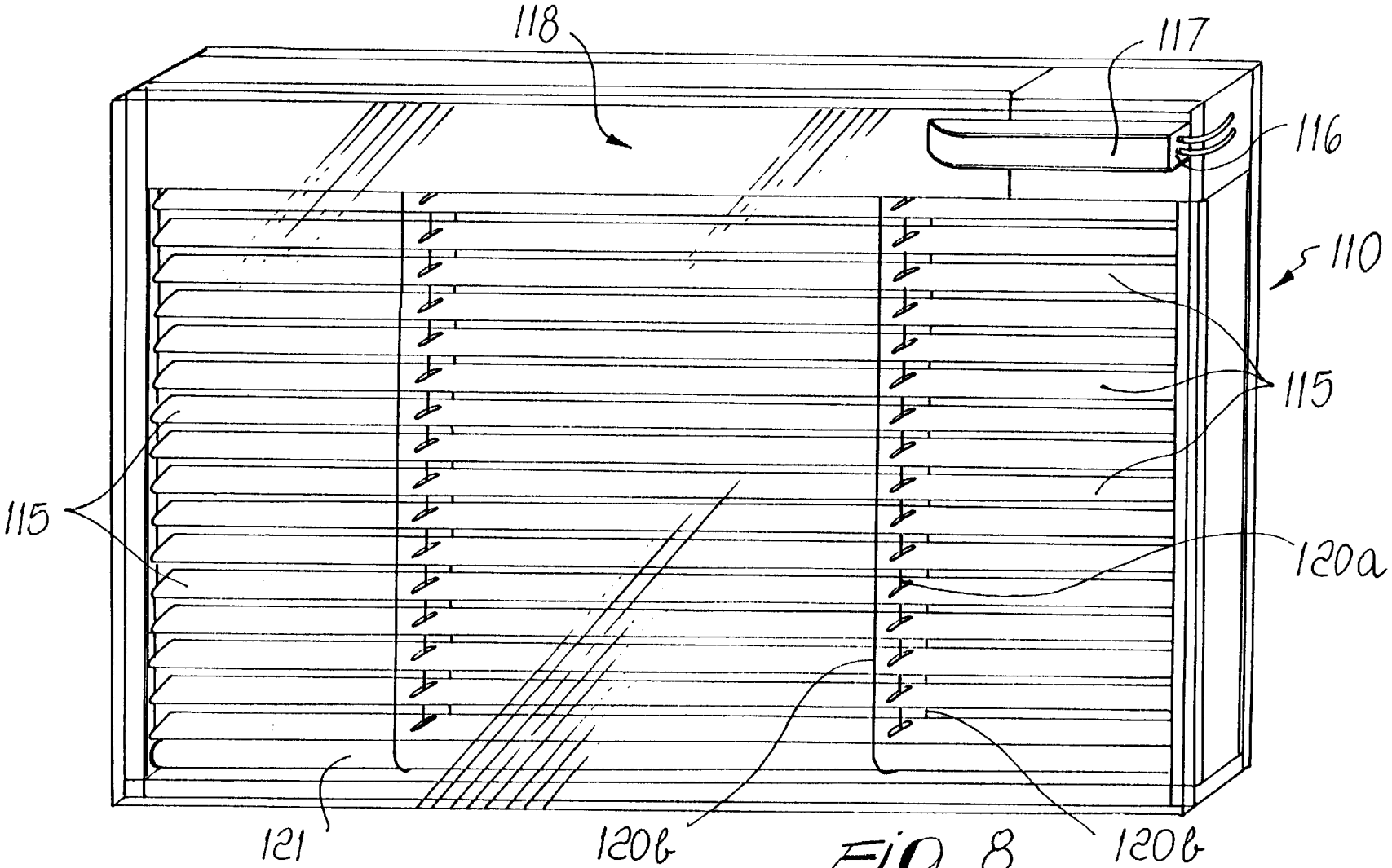
FIG. 8 is a perspective view of the blind of FIGS. 6 and 7, with the shading blind unfolded and the blackout blind gathered.

With particular reference to FIGS. 6, 7 and 8, an embodiment of an insulating glazing unit internally provided with a blind is designated, in this case, by the reference numeral 110 and comprises, in this constructive configuration, a shading blind 114 of the per se known type which is, in particular, a Venetian blind.

The blind comprises a plurality of slats 115 which are mutually connected by cords 120, some of which, as usually occurs, are cords 120*a* for orientating the slats 115, while the remaining cords are movement (traction) cords 120*b* which are meant to gather/unfold the blind 114.

The cords 120 can be wound around a shaft 119 which is arranged inside a box-like framework 118 which is provided at the upper frame of the insulating glazing unit 110.

The shaft 119 is actuated, by means of a kinematic coupling device not shown in the above figures and of the per se known type, by a traction motor 116 which is arranged outside the framework 118 inside a box-like body 117.

The Venetian blind 114 has, below the last slat 115, a structural bar 121 which is adapted to be coupled/uncoupled with respect to the bar 122 that supports a blind 113 which is constituted in this case by a pleated blind.

The blind, in the gathered condition, is arranged at the bottom of the insulating glazing unit 110.

First engagement/disengagement means are provided on said structural bar 121 and are constituted, in this case, by two first magnets 123, each of which is fixed at the face that is directed toward the lower part of the insulating glazing unit 110.

Correspondingly, second engagement/disengagement means are fixed on the bar 122 that supports the pleated bar 113 and are constituted by two second magnets 124, each of which, in this case, is larger than the corresponding first magnet 123 and is adapted to couple thereto when moved appropriately toward it.

Each one of said second magnets 124 is in fact fixed to the upper part of the bar 122 that supports the blind 113 so as to be substantially aligned with the first magnets 123.

In this manner, said structural bar 121 can conveniently couple/uncouple with respect to the bar 122 that supports the pleated blind 113.

Said blind, when blackout is not being provided, is gathered at the bottom of the insulating glazing unit 110, while the user can choose to lower or not the Venetian blind 114 in order to shade the insulating glazing unit 110.

When the user wishes to blackout the insulating glazing unit 110, he merely has to actuate the motor 116, which transmits its motion to the shaft 119, so as to fully lower the Venetian blind 114 so as to move the structural bar 121 toward the bar 122 that supports the pleated blind 113.

The coupling between said bars is of the magnetic type and occurs by simple approach.

Thereafter, the Venetian blind 114 is rewound, simultaneously lifting the pleated blind 113 from below until the insulating glazing unit 110 is blacked out completely.

When the user wishes to lower the pleated blind 113, gathering it again at the bottom of the insulating glazing unit 110, he merely has to actuate the motor 116 so that it begins to turn the shaft 119, lowering the structural bar 121 again and, accordingly, lowering the pleated blind 113 which is moved by it.

The magnetic uncoupling of the structural bar 121 and of the bar 122 that supports the blind 113 occurs, in this case, by means of the simple approach of a third magnet, not shown in the above figures, which the user must take care to move toward the two bars 121 and 122, between them, when they have reached the bottom of the insulating glazing unit 110.

In particular, said third magnet must be such as to couple to at least one of the two second magnets 124 strongly enough to overcome the preceding coupling to the first magnets 123.

As an alternative, it is possible to provide, at the bottom of the insulating glazing unit 110, an electromagnetic device which can be actuated by the user on command so as to produce, at the appropriate time, a magnetic field which attracts the two second magnets 124, overcoming the preceding coupling to the first magnets 123.

In another embodiment, not shown for the sake of simplicity, the insulating glazing unit is provided with a shading blind, for example of the Venetian type, below which a blackout blind is associated without any discontinuity.

Clearly, said blackout blind can be of the pleated type or of the type to be wound/unwound around a roller which is located in the lower part of the insulating glazing unit.

Accordingly, in this embodiment, when the blackout blind is gathered, the insulating glazing unit is shaded, while when the Venetian blind is gathered, the insulating glazing unit is blacked out.

In practice it has been observed that the present invention has solved more than satisfactorily the aim and all the objects.

In particular, a considerably important advantage has been achieved with the present invention by providing an insulating glazing unit internally provided with a blind which can at the same time also include a shading Venetian blind, so as to allow the user to choose, according to his requirements and in complete freedom, whether to shade or blackout the insulating glazing unit.

Another important advantage has been achieved by providing an insulating glazing unit provided with a blind which ensures complete blackout when it is unfolded.

Another advantage has been achieved with the present invention by providing an insulating glazing unit internally provided with a blind whose gathering and unfolding mechanism is highly functional and very simple.

Moreover, it is interesting to note once more that the present invention provides an insulating glazing unit with a blind which can be obtained in practice at costs which are fully comparable to those of commonly commercially available insulating glazing units.

The present invention is susceptible of numerous modifications and variations, all of which are within the scope of the same inventive concept.

All the details may furthermore be replaced with other technically equivalent elements.

In practice, the materials used, so long as they are compatible with the contingent use, as well as the dimensions, may be any according to requirements.

The disclosures in Italian Patent Application No. PD99A000052, from which this application claims priority, are incorporated herein by reference.

What is claimed is:

1. An insulating glazing unit internally provided with a blind which is adapted to be moved from a fully gathered configuration to an unfolded configuration, and vice versa, wherein said blind, in the fully gathered configuration, is completely arranged in a lower bottom part of the unit and selectively interacts with a traction device in order to unfold said blind from the lower bottom part upwardly into the unfolded configuration until said insulating glazing unit is fully blacked out, the unit comprising releasable engagement elements which selectively engage said blind with said traction device for unfolding said blind into the unfolded configuration and which are selectively released to completely disengage said traction device from said blind when said blind is in said fully gathered configuration.

2. The insulating glazing unit according to claim 1, wherein said engagement elements selectively engage said traction device with a bar which is connected with said blind.

3. The insulating glazing unit according to claim 2, wherein said traction device comprises flexible adjustment elements which are fixed at upper ends thereof to a shaft which is arranged longitudinally in an upper part of said insulating glazing unit and which is rotatably actuated by an actuation device, said flexible adjustment elements being fixed, at lower ends thereof, to a structural bar, said flexible adjustment elements, by unwinding and winding around said shaft, moving said structural bar vertically inside said insulating glazing unit.

4. The insulating glazing unit according to claim 3, wherein said flexible adjustment elements comprise orientation cords, which are suitable to modify an angle of inclination of said structural bar, and movement cords, which are adapted to produce a vertical translatory motion of said structural bar inside an air space of the unit.

5. The insulating glazing unit according to claim 4, wherein said releasable engagement elements comprise:

at least one pair of hooks, each of which is L-shaped and is fixed at a face of said structural bar that is directed toward the lower bottom part of the insulating glazing unit; and C-shaped elements whose number is equal to the number of said hooks and which are connected with an upper part of said bar associated with said blind.

6. The insulating glazing unit according to claim 5, wherein each one of said C-shaped elements comprises a flat back, which is fixed on top of said bar associated with said blind and from which two arc-like wings protrude from opposite positions and are folded above said flat back, an access region being formed between said arc-like wings through which said hooks may penetrate.

7. The insulating glazing unit according to claim 6, wherein in order to blackout said insulating glazing unit said shaft turns so that said orientation cords tilt said structural bar and, immediately thereafter, said movement cords move said structural bar until said structural bar is arranged adjacent the lower bottom part of said insulating glazing unit on which said bar associated with said blind is arranged and so as to rest said structural bar, due to an inclination thereof, on only one of the two arc-like wings of each one of said C-shaped elements, so that the corresponding hook penetrates through the access region and, due to a weight of the structural bar, which tends to modify an inclination of said structural bar after touching said wing, engages a region below the other wing, said shaft, by continuing to turn in a same direction, allowing the movement cords, which had reached an end stroke thereof, to rewind around said shaft, so as to raise said structural bar, which draws with said structural bar said bar that supports said blind.

8. The insulating glazing unit according to claim 6, wherein in order to lower said blind said shaft turns so that said orientation cords tilt said structural bar, to which said bar associated with said blind is coupled, and immediately thereafter said movement cords vertically lower said structural bar until said structural bar is arranged adjacent the lower bottom part of said insulating glazing unit and, once said blind has been gathered and the corresponding bar has been rested on the lower bottom part, due to an inclination of said structural bar, on only one of the two arc-like wings of each one of said C-shaped elements, so that the corresponding hook penetrates through the access region and, due to a weight of the structural bar, which tends to modify an inclination of said structural bar after touching said wing, disengages from a region below the other wing, said shaft, by continuing to turn in a same direction, allowing the movement cords, which had reached an end stroke thereof, to rewind onto said shaft, so as to raise said structural bar, which is uncoupled from said bar that supports said blind.

9. The insulating glazing unit according to claim 2, wherein said engagement elements comprise: at least one first magnet which is fixed on said structural bar at a face of said structural bar that is directed toward the lower bottom part of the insulating glazing unit; and at least one second magnet, which is fixed to an upper part of said bar which is associated with said blind and which is adapted to induce a magnetic field which is stronger than a field of the corresponding first magnet, with which the second magnet is aligned, and to couple to the first magnet by simply approaching the first magnet.

10. The insulating glazing unit according to claim 9, further comprising a third magnet movable toward and between said structural bar and said bar in order to uncouple said structural bar and said bar when said structural bar and said bar have reached the lower bottom part of said insulating glazing unit, said third magnet being such as to couple to said at least one second magnet, inducing a magnetic field which overcomes a previous coupling of said at least one second magnet with said at least one first magnet.

11. The insulating glazing unit according to claim 1, further comprising, at the lower bottom part of said insulating glazing unit, an electromagnetic device which is activatable by a user so as to induce a magnetic field which can attract, for a mutual uncoupling of said structural bar and said bar when said structural bar and said bar have reached the lower bottom part of said insulating glazing unit, said at least one second magnet, overcoming a previous coupling with said at least one first magnet.

12. The insulating glazing unit according to claim 1, further comprising, at each one of two posts of a frame that supports said insulating glazing unit, a vertical seat inside which lateral ends of said blind can slide during an unfolding and a gathering of said blind, so as to prevent any light rays from filtering through the unit.

13. The insulating glazing unit according to claim 1, further comprising a shading blind.

14. The insulating glazing unit according to claim 13, wherein said blind is fixed to said shading blind by means of an upper flap of said blind.

15. The insulating glazing unit according to claim 14, wherein said blind is a pleated blind.

16. The insulating glazing unit according to claim 1, wherein said blind is gaterable and unfoldable around a roller arranged in the lower bottom part of said insulating glazing unit.

17. The insulating glazing unit according to claim 16, wherein said roller is provided with an elastic return spring for an automatic gathering of said blind.

* * * * *